United States Patent [19]

Nakayama et al.

[11] Patent Number: 4,484,869

[45] Date of Patent: Nov. 27, 1984

[54] VOLUMETRIC FLUID COMPRESSOR

[75] Inventors: Shozo Nakayama, Kariya; Mitsukane Inagaki, Anjo; Shigeru Suzuki, Nishio; Takashi Ban, Obu, all of Japan

[73] Assignee: Kabushiki Kaisha Toyoda Jidoshokki Seisakusho, Kariya, Japan

[21] Appl. No.: 370,307

[22] Filed: Apr. 21, 1982

[30] Foreign Application Priority Data

Apr. 24, 1981 [JP] Japan ..... 56-62938

[51] Int. Cl.[3] ..... F04C 18/02; F04C 29/02

[52] U.S. Cl. ..... 418/55; 418/86; 418/151

[58] Field of Search ..... 418/55, 94, 98, 151, 418/83, 86, 181

[56] References Cited

U.S. PATENT DOCUMENTS 4,065,279 12/1977 McCullough ..... 418/55 X
4,357,132 11/1982 Kousokabe ..... 418/55
4,389,171 6/1983 Eber et al. ..... 418/55 X

FOREIGN PATENT DOCUMENTS 55-43219 3/1980 Japan ..... 418/55

*Primary Examiner*—John J. Vrablik
*Assistant Examiner*—Theodore Olds
*Attorney, Agent, or Firm*—Jordan and Hamburg

[57] ABSTRACT

A volumetric fluid compressor or a so-called scroll type compressor is provided in which a rotary shaft is placed centrally in the front side of a housing, a helical portion of a movable scroll member is contacted eccentrically with a helical portion of a fixed scroll member, the helical portion of the movable scroll member is rotated about the axis of the rotary shaft to which the movable scroll member is mounted with an offset, in such a manner that a closed space defined between the two helical portions may be contracted towards the center for compressing the refrigerant gas which may thus be discharged towards rear from the center of the fixed scroll member. A stationary member for preventing the rotation of movable scroll member is secured in the housing about centrally of the longitudinal axis of the housing for defining a suction chamber towards the front side of the housing and a working chamber on the rear side of the housing, the fixed and movable scroll members being provided within the working chamber. A suction port is formed in the housing directly above the rotary shaft for introducing the fluid to be compressed into the suction chamber whereas a plurality of suction passageways are formed in the stationary ring for introducing the fluid to be compressed from the forward side suction chamber into the rear side working chamber.

7 Claims, 13 Drawing Figures

FIG.13 *PRIOR ART*

VOLUMETRIC FLUID COMPRESSOR

FIELD OF THE INVENTION

This invention relates to a volumetric fluid compressor, or a so-called scroll type compressor, in which a helical portion of a movable scroll member is contacted eccentrically with a helical portion of a fixed scroll member, the helical portion of the movable scroll member is rotated about the rotary axis, in such a manner that a closed space defined between the two helical portions may be contacted towards the center for compressing the refrigerant gas which may thus be discharged towards rear from the center of the fixed scroll member.

BACKGROUND OF THE INVENTION

In general, volumetric fluid compressors of this kind comprises a suction chamber 100 and a discharge chamber 102 on the rear side of a housing 1, as shown in FIG. 13, with an offset shaft 8 being connected to the inner end of a rotary shaft 6 which in turn is passed through the front end side of the housing. A movable scroll member 9 is rotatably mounted to the offset shaft 8 by a radial bearing 10 and, for preventing the rotation of the movable scroll member 9 about its own axis, a stationary ring 11 is fitted to the inner periphery of the housing 1. Refrigerant gases are directed from a working chamber 101 defined at the rear side of the stationary ring 11, towards a radial bearing 21 for the rotary shaft 6, a shaft sealing device 7 and a thrust bearing 22 for a balance weight 14, for cooling and lubrication of these components by way of a channel 11*c* in the ring 11 and a channel 1*b* in the housing 1. Refrigerant gases are also supplied centrifugally to the radial bearing 10 for cooling and lubrication thereof from a passage 23 extending obliquely on the rotary shaft 6 and the offset shaft 8.

With such conventional lubrication system, a sufficient centrifugal force may not be realized because of reduced offset amount of the offset shaft 8. Such inconvenience may be more outstanding during low speed revolution to thereby decrease in lubrication and cooling effects. Moreover, the rotary shaft 6, balance weight 14 and the bearings 10, 21 are mounted in their entirety in a space defined by the stationary ring 11 on the front side of the housing 1, thus proving to be a hindrance to intrusion of the fresh refrigerant gases and decreasing the cooling and lubrication efficiency.

OBJECTS OF THE INVENTION

It is an object of the present invention to provide a volumetric fluid compressor wherein the fluid to be compressed may be supplied smoothly to various parts of the drive system, such as rotary shaft, for improving the cooling and lubrication capability.

It is a further object of the present invention to provide a volumetric fluid compressor wherein the fluid to be compressed may be smoothly delivered from the suction chamber to the working chamber.

It is a further object of the present invention to provide a volumetric fluid compressor wherein especially the shaft seal mechanism and the bearing of the rotary shaft may be satisfactorily cooled and lubricated.

It is another object of the present invention to provide a volumetric fluid compressor wherein the bearing between a movable scroll member and an offset shaft at the inner end of the rotary shaft may be effectively cooled and lubricated.

Other and further objects of this invention will become obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

FIG. 13 is a central longitudinal view showing a conventional volumetric fluid compressor.

DETAILED DESCRIPTION OF THE PREFERRED EMBODIMENTS

Figure 1:
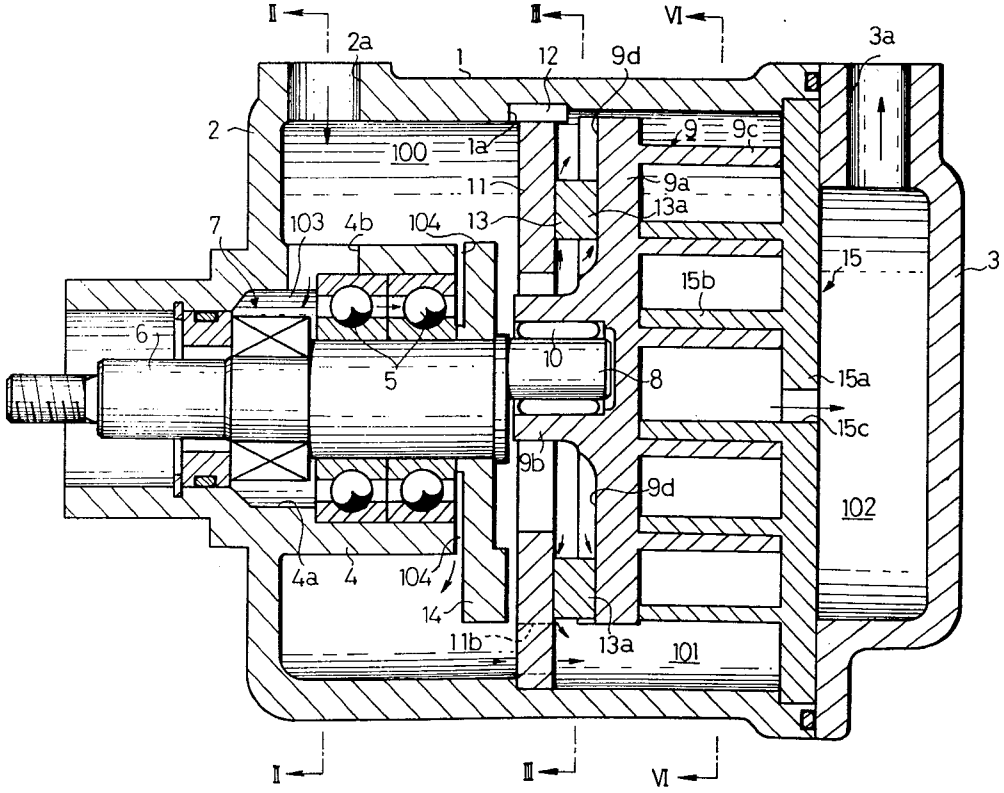
FIG. 1 is a central longitudinal section of the volumetric fluid compressor according to a preferred first embodiment of the invention.
Figure 2:
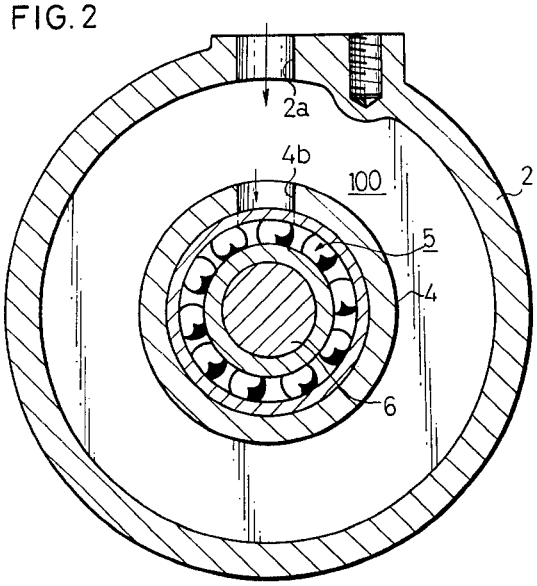
FIG. 2 is a sectional view taken along line II—II of FIG. 1.
Figure 4:
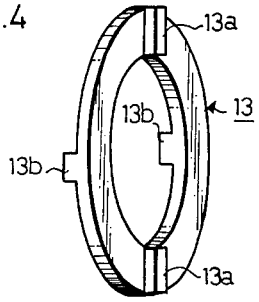
FIG. 4 is a perspective view of a toroidal ring member.

Referring to FIGS. 1 to 6 for illustration of the first embodiment of the invention, a central housing 1 has a forward portion integrally formed with a front housing 2 and a rear end face to which a rear housing 3 is secured by clamp bolts, not shown.

The central portion of the front housing 2 has an integral cylindrical boss portion 4 having a central bore 4*a* in which a rotary shaft 6 is carried by fore and aft radial ball bearings 5, said rotary shaft 6 is connected at the outer end thereof to a drive source, not shown. A shaft seal mechanism 7 is interposed between the rotary shaft 6 and the boss portion 4, and an inlet port 4*b* is formed on the upper base of the boss portion 4 for establishing communication with the upper portion of a sealing chamber 103 in which the seal mechanism 7 is housed.

Figure 6:
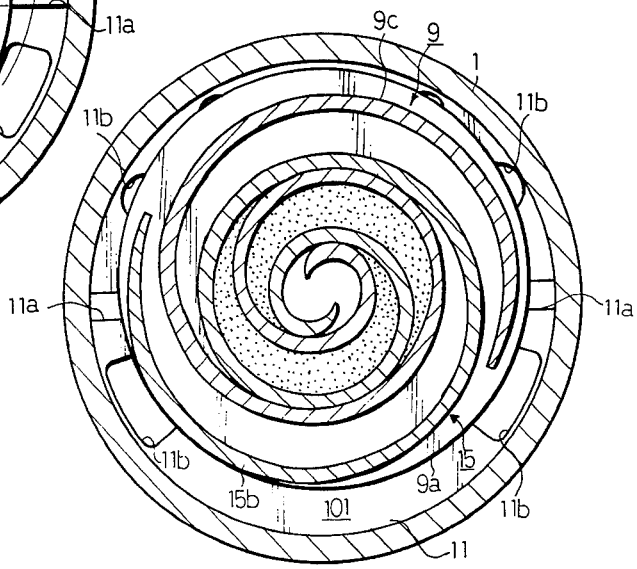
FIG. 6 is a sectional view taken along line VI—VI of FIG. 1.

An offset shaft 8 is connected to the inner end of the rotary shaft 6 and, on the offset shaft 8, a boss 9*b* integrally formed on the central portion of the left-hand surface in FIG. 1 or the rear surface of a disc 9*a* of a movable scroll member 9 is rotatably mounted by means of a radial needle bearing 10. The right-hand face or front surface of the movable scroll member 9 has an integral spiral portion 9*c* as shown in FIG. 6.

Figure 5:
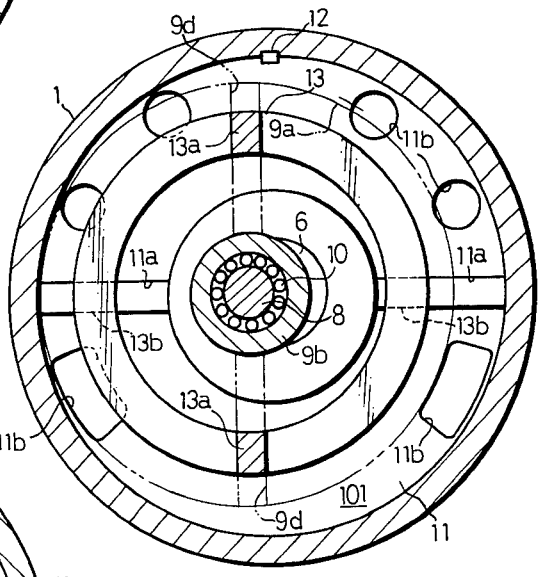
FIG. 5 is a sectional view showing the operative state advanced by 90 degrees in phase relative to the state of FIG. 3
Figure 3:
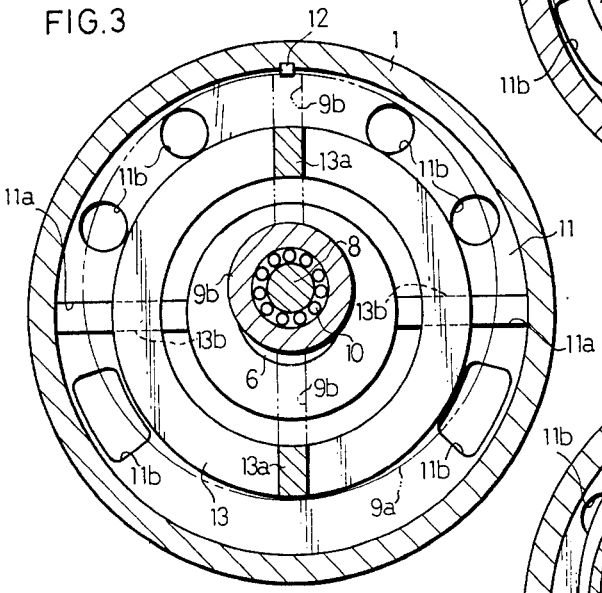
FIG. 3 is a sectional view taken along line III—III of FIG. 1.

The axially central portion of the inner surface of the central housing 1 is formed with an annular engaging step 1*a* to which a stationary ring 11 is connected by a key or spline 12 on the outer peripheral surface of the ring 11, said ring 11 being thus inhibited against rotation and adapted to inhibit the rotation of the movable scroll member 9 about its own axis. By this stationary ring 11, the inner space of the central housing 1 is divided into a fore chamber or a suction chamber 100 on the side of the boss 4 and an aft chamber or a working chamber 101 on the side of the movable scroll member 9. A refrigerant gas is introduced into the suction chamber 100 through suction port 2*a* formed in the upper peripheral portion of the front housing 2, said suction port 2*a* being positioned directly above the boss portion 4. Around the outer peripheral portion of the stationary ring 11, six suction passageways 11*b* are provided for introducing the refrigerant gas from the suction chamber 100 into the working chamber 101, as shown in FIGS. 3 and 5. Two of these suction passageways are provided at the lower portion of the stationary ring 11.

On the rear surface of the disc 9*a* of the movable scroll member 9, guide grooves 9*d* are formed vertically through the center of the disc, as shown in FIGS. 1 and 3, these guide grooves being used for preventing the rotation of the movable scroll member about its own axis. On the right-hand surface or rear surface of the stationary ring 11 guide grooves 11*a* are provided transversely through the center of the ring, as shown in FIG. 3, said guide grooves being also used for preventing the rotation of the movable scroll member 9 about its own axis. A toroidal ring member 13 is provided with two vertical projections 13*a* on a rear surface thereof and two lateral projections 13*b* on a front surface thereof. The upper and lower integral projections 13*a* on the right-hand or rear surface of the toroidal ring member 13 (FIG. 4) are engaged vertically slidably in the guide grooves 9*d*, whereas the two lateral integral projections 13*b* on the left-hand or front surface of the ring member 13 are engaged transversely slidably in the guide grooves 11*a*.

Thus, when the offset shaft 8 is caused to rotate counterclockwise by e.g. 90 degrees by rotary shaft 6, with delineating a quarter circle, since the two integral projection 13*b* of the ring member 13 are regulated by the guide grooves 11*a* of the stationary ring 11, the ring member 13 is made to travel towards left in FIG. 5 along a straight passage defined by the guide groove 11*a*. Thus the disc 9*a* are also displaced towards left as they remain in their vertical position. As the movable scroll member 9 is moved towards left, the movable scroll member 9 moves downwardly relative to the ring member 13 along the guide groove 9*d*. Thus, the movable scroll member 9 is moved vertically and transversely, but the movable scroll member 9 is inhibited against rotation about its own axis.

A balance weight 14 in the form of a disc is secured to the inner end of the rotary shaft 6 for providing smooth rotation of the movable scroll member 9 about the axis of the rotary shaft 6. Between the balance weight 14 on the one hand and the radial ball bearing 5 and the end face of the boss portion 4 on the other hand, there is defined a gap 104 adapted for passage of the refrigerant gas.

Thus, when the shaft 6 is rotated for providing the compressive operation, the main portion of the refrigerant gas introduced from the inlet port 2*a* of the front housing 2 into the suction chamber 100 is directly introduced into the working chamber 101 through the plural suction passageways 11*b* in the stationary ring 11. At this time, part of the refrigerant gas is introduced the inlet port 4*b* into the sealing chamber 103 for cooling and lubricating the shaft sealing mechanism 7 and the radial ball bearing 5. Thereafter, the refrigerant gas is introduced into a gap 104 defined by the balance weight 14, the bearing 5 and end face of the boss portion 4 through the gap of the bearing 5. Then, the gas is forced to be shifted outwards under the centrifugal force developed by rotation of the balance weight 14, and is thus returned into the suction chamber 100 to be thence introduced under suction into the working chamber 101 by way of suction passageways 11*b* in the stationary ring 11.

The peripheral rim of a disc 15*a* of a stationary scroll member 15 is fixedly clamped between the end faces of the central housing 1 and the rear housing 3. A helical portion 15*b* is integrally mounted with the front surface of the disc 15*a*. The disc 15*a* is so positioned that the helical portion 15*b* may have two or more local contact places or points at all times with the helical portion 9*c* of the movable scroll member 9, as shown in FIG. 6. A discharge passage 15*c* is formed in the disc 15*a* about centrally thereof for discharging compressed refrigerant gas into a discharge chamber 102 defined between the rear housing 3 and the disc 15*a*.

Thus, when the helical portion 9*c* of the movable scroll member 9 is rotated counterclockwise in FIG. 6 by rotation of the offset shaft 8 about the axis of the rotary shaft 6 while being locally contacted with the helical portion 15*b* of the fixed scroll member 15, the contact points between the helical portions 9*c*, 15*b* meshing with each other are shifted towards the center on the inner surface of the helical portion 15*b*. Thus a closed space defined by the two contact points or places (the space indicated with many dots in FIG. 6) is gradually shifted towards center, while compressing the entrapped gas. The refrigerant gas is discharged from the discharge passage 15*c* into the discharge chamber 102, and may thus be supplied under pressure into an external circuit by way of a discharge port 3*a* provided to the upper portion of the rear housing 3.

In the above first embodiment of the invention, the suction chamber 100 is defined towards the side of the front housing 2 by means of the stationary ring 11 disposed in turn in the central housing 1. The inlet opening 4*b* is formed in the boss portion 4 for communication with the seal chamber 103, and the gap 104 is provided between the balance weight 14 secured to the inner end of the rotary shaft 6 on the one hand and the end faces of the bearing 5 and the boss portion 4 on the other hand. Under the centrifugal force, developed by rotation of the balance weight 14, the refrigerant gas may be forcedly circulated from the suction chamber 100 the inlet port 4*b*, thence into the sealing chamber 103, thence into the gap of the bearing 5, thence into the gap 104 and thence into the suction chamber 100 for positively cooling and lubricating the shaft seal mechanism 7 and the bearing 5.

In the present embodiment, the suction port 2*a* and the inlet port 4*b* are provided respectively in the suction chamber 100 and the boss portion 4 in register with one another, and the suction passageways 11*b* are formed in the lower as well as upper portions of the fixed ring 11, so that part of the refrigerant gas tends to be sucked towards below by way of the boss portion 4. Thus, when the centrifugal force of the balance weight 14 is still small during low speed operation, the refrigerant gas flow may be produced along the above route for positive cooling and lubrication of the shaft sealing mechanism 7 and the bearing 5.

Moreover, the radial needle bearing 10 is subject at all times to fresh refrigerant gases and may thus be effectively cooled and lubricated. Similary, fresh refrigerant gases flow into and through the sliding zone between the ring member 13 and the disc 9*a* and between the disc 9*a* and the fixed ring 11, as shown by the arrow mark in FIG. 1 so that the zone may also be subject to fresh refrigerant gases and may thus be effectively cooled and lubricated.

Figure 7:
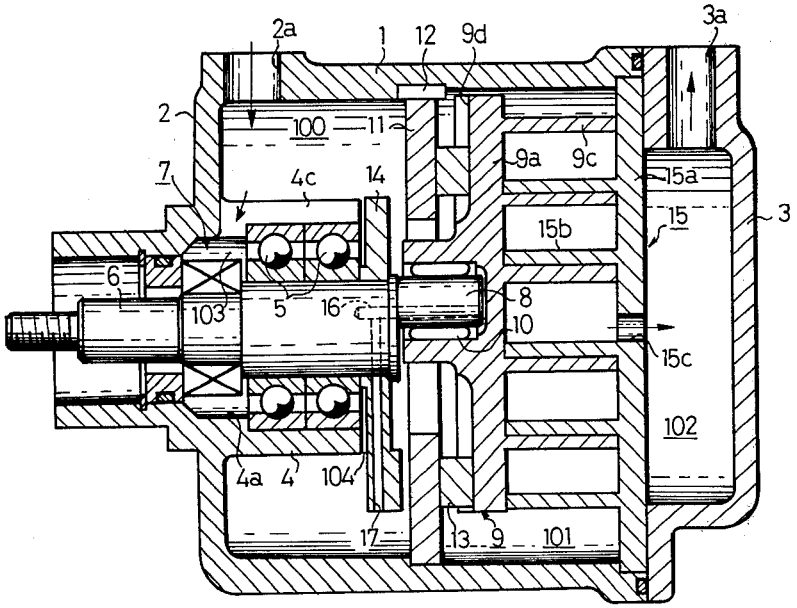
FIGS. 7, 8 and 9 are the central longitudinal views of the second, third and fourth embodiments of the present invention, respectively.
Figure 8:
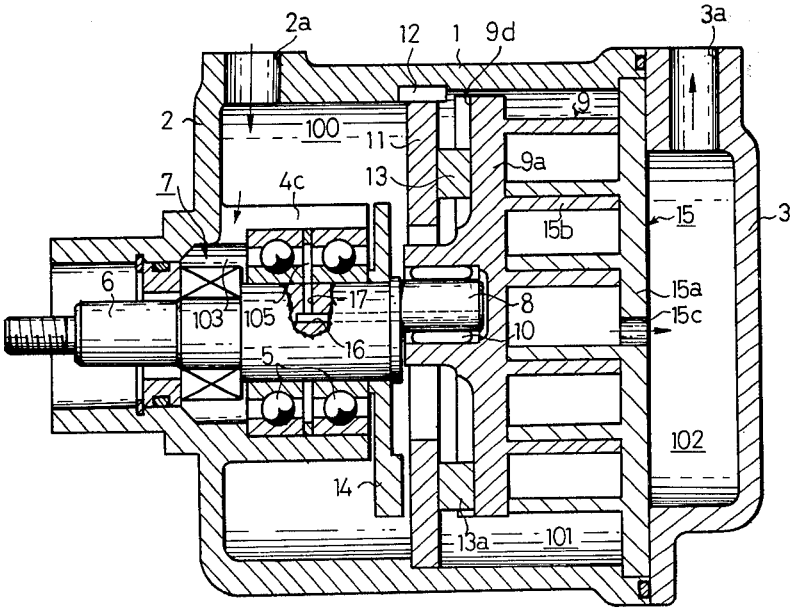
Figure 9:
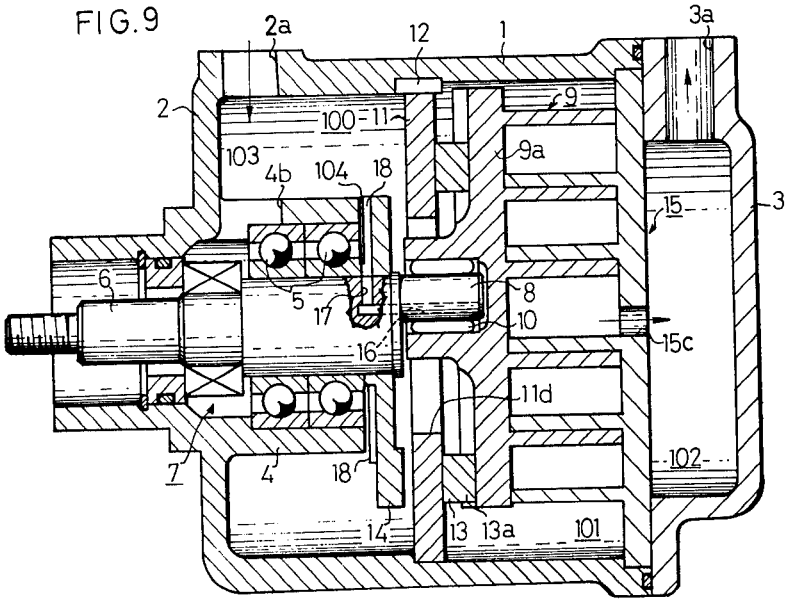

Reference is now made to FIGS. 7 to 9 for illustration of the second to fourth embodiments of the invention.

In the second embodiment, shown in FIG. 7, a bore-like passage 16 is to extend from the end face of the offset shaft 8 in the direction of the rotary shaft 6, while a similar bore-like passage 17 is provided to extend from the peripheral surface of the balance weight 14 to the inner end of the passage 16. Thus the bearing 10 may be effectively cooled and lubricated by the refrigerant gas which is made to flow repeatedly from the suction chamber 100 into the radial bearing 10, thence into the passages 16, 17 in this order, and back into the suction chamber 100, under the effect of the centrifugal force of the balance weight 14.

In the present case an inlet groove 4*c* is provided to the upper part of the boss portion 4 for more facilitated entrance of the refrigerant gas into the radial bearing 5. Otherwise the construction and operation of the present embodiment are similar to that of the preceding embodiment.

In the third embodiment, shown in FIG. 8, a gap 105 is provided between the two radial bearings 5, and the passage 17 is opened into the gap 105 for more effective cooling and lubrication of the bearings 5, otherwise, the construction and operation of the present embodiment is similar to that of the preceding first embodiment.

Figure 10:
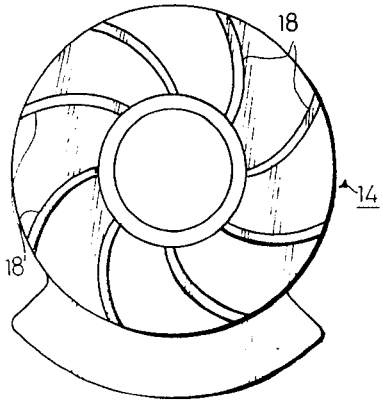
FIG. 10 is a front view of a balance weight used in the embodiment of FIG. 9.
Figure 12:
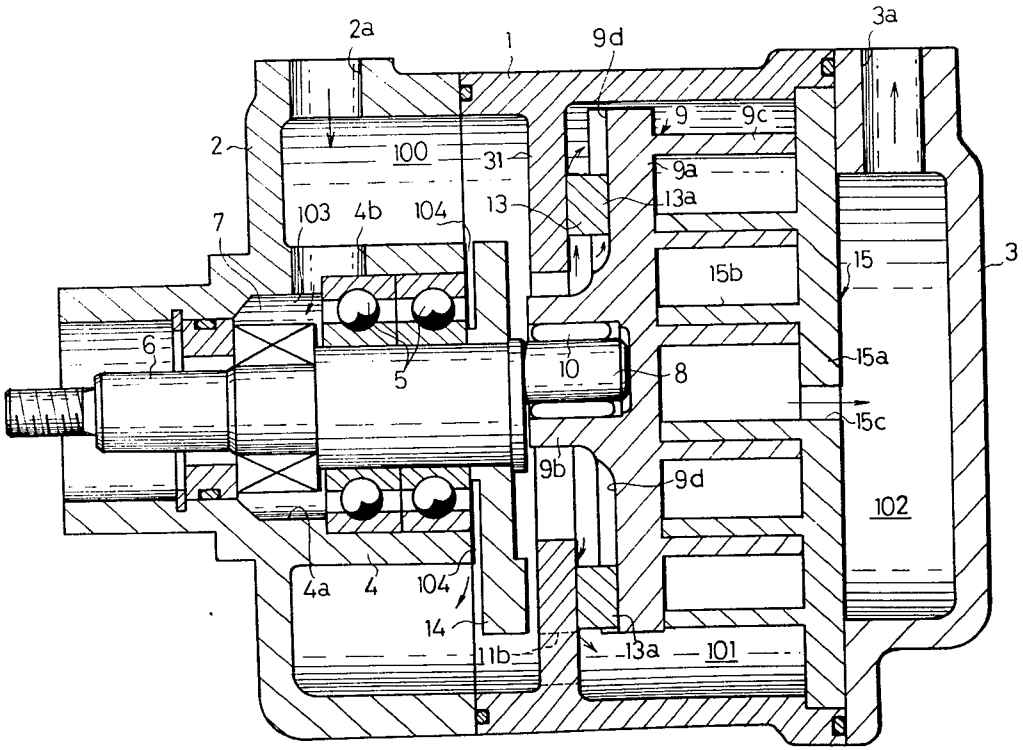
FIG. 12 is a sectional view showing a modification of the stationary member.

In the fourth embodiment, shown in FIG. 9, the passage 17 is opened into a gap 104 defined between the bearing 5 and the end face of the boss portion 4 on the one hand and the balance weight 14 on the other, and the left-hand face of the balance weight 14 as viewed in FIG. 9 is integrally provided with plural radially extending vane-like projections 18, as shown in FIG. 10, for forcing the refrigerant gas from the passage 17 outwards for more effective cooling and lubrication of the radial bearing 10. Otherwise, the construction and operation of the present embodiment is similar to that of the preceding first embodiment.

Figure 11:
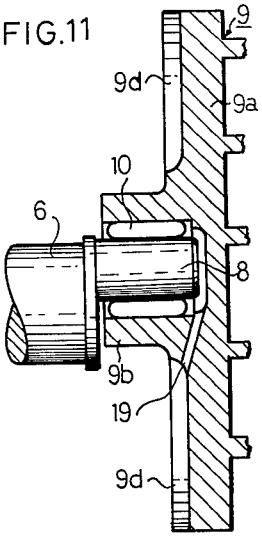
FIG. 11 is a sectional view showing a modification of the movable scroll member.
Figure 11:
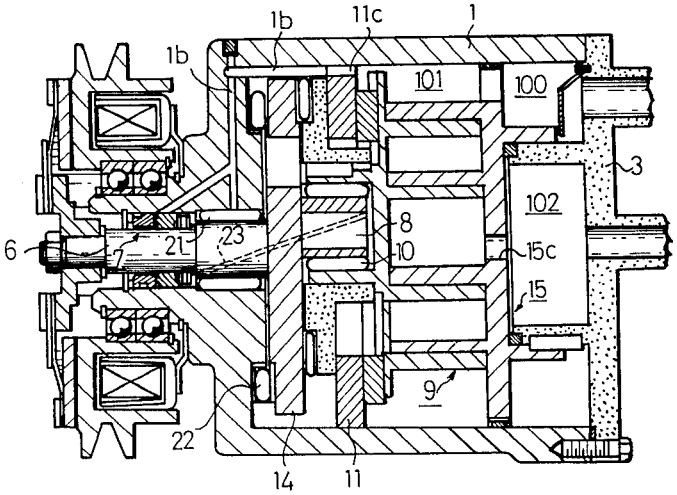

In a further modification shown in FIG. 11, a slanted passage 19 is provided to the base part of a cylindrical boss portion 9*b* of a movable scroll member 9, said passage being opened at either ends in the inner bottom of the boss portion 9*b* and the front face of the movable scroll member 9. In this modification, a gas flow may be generated under the pressure differential existing on either sides of the fixed ring 11, the gas flowing from the radial bearing 10 into the passage 19 for effective cooling and lubrication of the radial bearing 10.

In each of the above embodiments, suction passages 11*b* in the fixed ring 11 may be replaced by an opening of the ring 11 itself (indicated at 11*d* in FIG. 9). In this case, a space adapted for passage of refrigerant gases must be provided between the fixed ring 11 and the disc 9*a*.

In each of the above embodiments, the stationary ring 11 is provided separately from the central housing 1. However, it is possible that the fixed ring 11 is provided integrally with the housing 1 and may be regarded as the flange portion 31.

As described above, the suction chamber is defined towards the front side of the housing, so that the fluid to be compressed may be smoothly supplied to various parts of the drive system such as rotary shaft for more effective cooling and improved lubricating operation.

It is apparent that broadly different embodiments may be conceived without departing from the spirit and scope of the invention and therefore the invention is not limited to any specific embodiments except as defined in the appended claims.

What is claimed is:

1. A volumetric fluid compressor comprising, a housing having a suction chamber with a suction port, and a discharge chamber therein;

a rotary shaft rotationally mounted in the center of the housing, said rotary shaft having an offset shaft at one end inside the housing, a fixed scroll member situated inside the housing and having a helical portion extending inwardly therefrom, a movable scroll member situated inside the housing so that the movable scroll member can move in all directions in a plane perpendicular to the axis of the housing but can not rotate relative to the housing, said movable scroll member being rotationally engaged with the offset shaft and having a helical portion meshing with the helical portion of the fixed scroll member so that when the rotary shaft is rotated, fluid introduced into the housing through the suction chamber is compressed by the helical portions of the fixed and movable scroll members and is discharged from the discharge chamber, a boss portion integrally formed with the housing and situated in the suction chamber of the housing, said boss portion having a side portion facing substantially perpendicular to the axis of the housing and an inlet opening perpendicular to the side portion, said inlet opening directly facing and axially aligned with the suction port of the housing so that the fluid introduced into the suction chamber can smoothly enter into the inlet opening, bearing means situated inside the boss portion downstream of the inlet opening for rotationally supporting the rotary shaft, and a balance weight connected to the rotary shaft adjacent to the boss portion so that a gap is formed between the balance weight and the side portion of the boss portion, whereby when the fluid is compressed by the scroll members, the fluid passes through the inlet opening of the boss portion, the bearing means and the gap to thereby continuously lubricate the bearing means.

2. A volumetric fluid compressor according to claim 1 further comprising a bearing for the offset shaft for rotationally supporting the movable scroll member, and a passage situated inside the rotary shaft and the offset shaft and extending from the end of the offset shaft to the outer surface of the rotary shaft so that when the compressor operates, the fluid in the suction chamber flows through the bearing for the offset shaft and returns to the suction chamber by passing through the passage by means of centrifugal force due to the rotation of the rotary shaft.

3. A volumetric fluid compressor according to claim 2, in which said balance weight is provided with a passage communicating with the passage extending through the rotary shaft and the offset shaft, said passage of the balance weight terminating at the outer periphery thereof.

4. A volumetric fluid compressor according to claim 2, in which said passage extending from the end of the offset shaft terminates inside the bearing means for facilitating cooling and lubricating of the bearing means.

5. A volumetric fluid compressor comprising, a housing having a suction chamber and a discharge chamber therein, a rotary shaft rotationally mounted in the center of the housing, said rotary shaft having an offset shaft at one end inside the housing, a fixed scroll member situated inside the housing and having a helical portion extending inwardly therefrom, a movable scroll member situated inside the housing so that the movable scroll member can move in all directions in a plane perpendicular to the axis of the housing but can not rotate relative to the housing, said movable scroll member being rotationally engaged with the offset shaft and having a helical portion meshing with the helical portion of the fixed scroll member so that when the rotary shaft is rotated, fluid introduced into the housing through the suction chamber is compressed by the helical portions of the fixed and movable scroll members and is discharged from the discharge chamber, a boss portion integrally formed with the housing and situated in the suction chamber of the housing, said boss portion having a side portion facing substantially perpendicular to the axis of the housing and an inlet opening perpendicular to the side portion, bearing means situated inside the boss portion downstream of the inlet opening for rotationally supporting the rotary shaft, a bearing for the offset shaft for rotationally supporting the movable scroll member, a balance weight connected to the rotary shaft adjacent to the boss portion so that a gap is formed between the balance weight and the side portion of the boss portion, whereby when the fluid is compressed by the scroll members, the fluid passes through the inlet opening of the boss portion, the bearing means and the gap to thereby continuously lubricate the bearing means, said balance weight further including a plurality of vane-like projections on the surface facing the gap, and a passage situated inside the rotary shaft and the offset shaft and extending from the end of the offset shaft to the outer surface of the rotary shaft, communicating with the gap between the balance weight and the side portion of the boss portion, so that when the compressor operates, the fluid in the suction chamber also flows through the bearing for the offset shaft and returns to the suction chamber by passing through the passage by means of centrifugal force due to the rotation of the rotary shaft.

6. A volumetric fluid compressor comprising, a housing having a suction chamber and a discharge chamber therein;

a rotary shaft rotationally mounted in the center of the housing, said rotary shaft having an offset shaft at one end inside the housing, a fixed scroll member situated inside the housing and having a helical portion extending inwardly therefrom, a movable scroll member situated inside the housing so that the movable scroll member can move in all directions in a plane perpendicular to the axis of the housing but can not rotate relative to the housing, said movable scroll member being rotationally engaged with the offset shaft and having a helical portion meshing with the helical portion of the fixed scroll member so that when the rotary shaft is rotated, fluid introduced into the housing thorugh the suction chamber is compressed by the helical portions of the fixed and movable scroll members and is discharged from the discharge chamber, a boss portion integrally formed with the housing and situated in the suction chamber of the housing, said boss portion having a side portion facing substantially perpendicular to the axis of the housing and an inlet opening perpendicular to the side portion, bearing means situated inside the boss portion downstream of the inlet opening for rotationally supporting the rotary shaft, a balance weight connected to the rotary shaft adjacent to the boss portion so that a gap is formed between the balance weight and the side portion of the boss portion, whereby when the fluid is compressed by the scroll members, the fluid passes through the inlet opening of the boss portion, the bearing means and the gap to thereby continuously lubricate the bearing means, a bearing for the offset shaft for rotationally supporting the movable scroll member, and a passage situated inside the rotary shaft and the offset shaft, said passage extending from the end of the offset shaft to the outer surface of the rotary shaft and communicating with the gap between the balance weight and the side portion of the boss portion so that when the compressor operates, the fluid in the suction chamber also flows through the bearing for the offset shaft and returns to the suction chamber by passing through the passage by means of centrifugal force due to the rotation of the rotary shaft.

7. A volumetric fluid compressor according to claim 6, in which said balance weight is provided with a plurality of vane-like porjections on the surface facing the gap so that the fluid flowing through the passage is forcibly conveyed outwardly from the passage when the rotary shaft rotates.

* * * * *